United States Patent [19]

James

[11] 4,326,637

[45] Apr. 27, 1982

[54] HANG-RACK ASSEMBLY

[76] Inventor: Roger T. James, 1060 S. Charlotte, Lombard, Ill. 60148

[21] Appl. No.: 143,621

[22] Filed: Apr. 28, 1980

[51] Int. Cl.[3] ..... A47F 7/24; A47F 5/10

[52] U.S. Cl. ..... 211/175; 211/201

[58] Field of Search ..... 211/175, 123, 201, 202, 211/204, 206, 175, 189

[56] References Cited

U.S. PATENT DOCUMENTS

| | | | |
|---|---|---|---|
| 2,469,911 | 5/1949 | Applegate | 211/201 |
| 2,885,090 | 5/1959 | Forman | 211/175 |
| 3,559,339 | 2/1971 | Worley | 211/201 |
| 4,111,309 | 9/1978 | Henry | 211/201 |
| 4,253,578 | 3/1981 | Rekow | 211/204 |

FOREIGN PATENT DOCUMENTS

| | | | |
|---|---|---|---|
| 312118 | 5/1929 | United Kingdom | 211/201 |

*Primary Examiner*—Reinaldo P. Machado

*Attorney, Agent, or Firm*—Henry J. Gens

[57] ABSTRACT

A collapsible hang-rack assembly for supporting and displaying merchandise, such as garments, the assembly having a base structure having one or more end walls which can be extended outwardly of the base structure by means of interconnecting members, such as hang-rods and tie rods, the hang-rods also functioning to stabilize the assembly in the extended form. In its collapsed form, the assembly presents a compact unit for merchandise display, storage or transit. The interconnecting members are adapted to be disposed within the base structure or within the end wall so that they are hidden from view. The interconnecting members may have a construction to allow adjustability in length so that the hanging support for the garments may be varied within a predetermined range. The base structure comprises a framework which can be fitted around a post or column in a store display area.

15 Claims, 8 Drawing Figures

FIG. 1
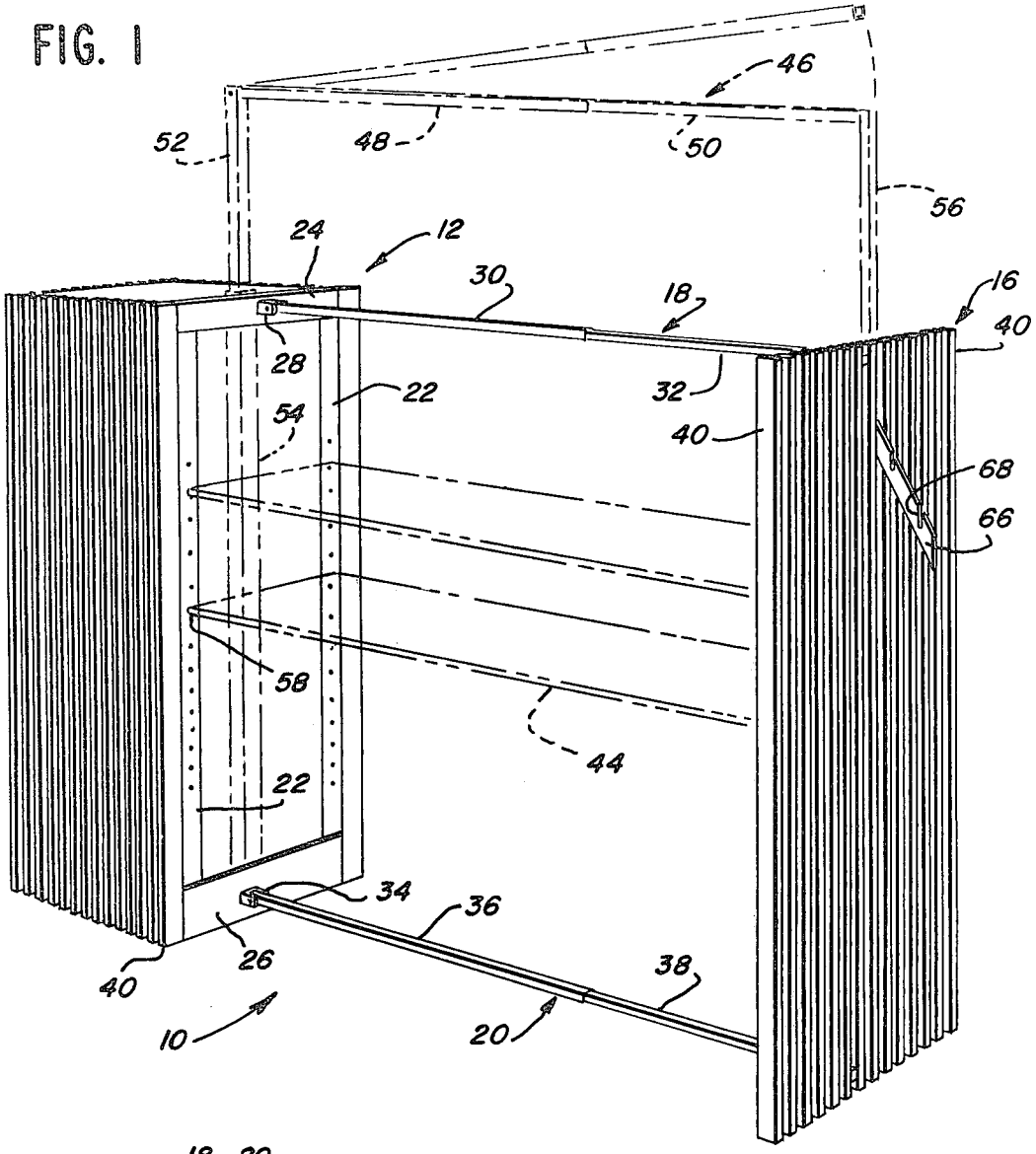
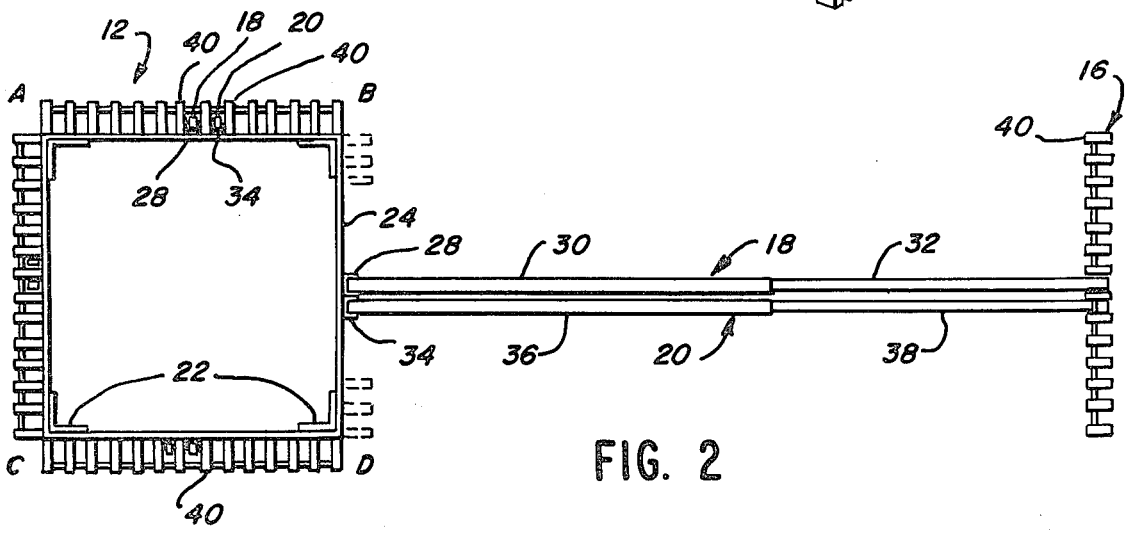
FIG. 2

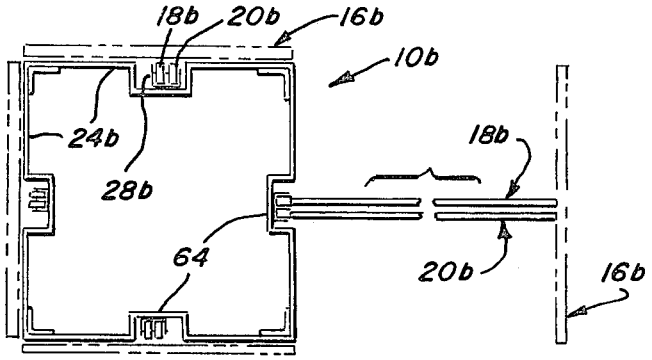
FIG. 8
FIG. 3
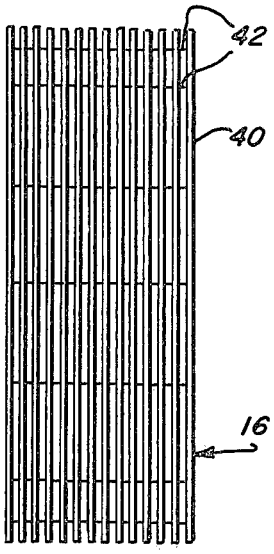
FIG. 4
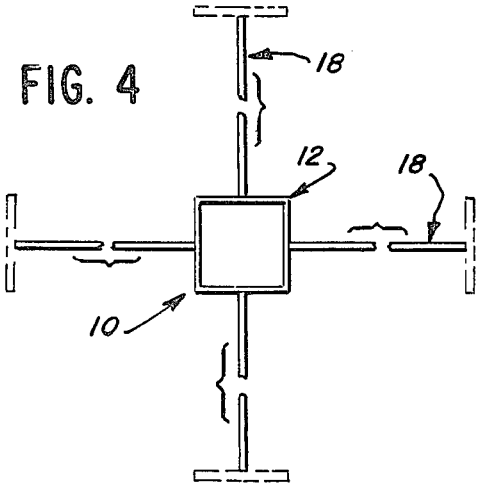
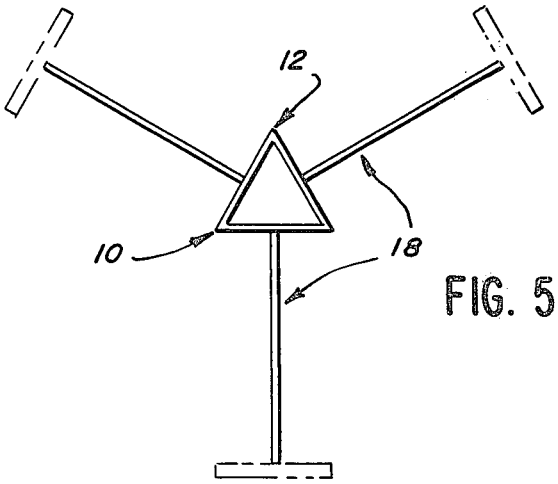
FIG. 5
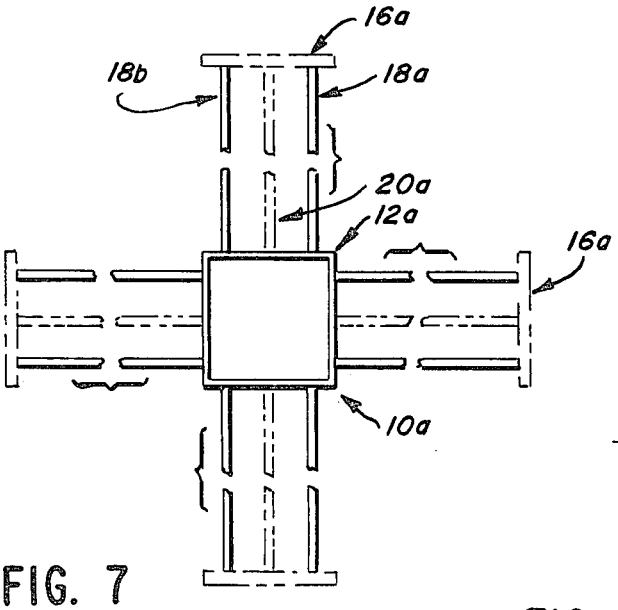
FIG. 7
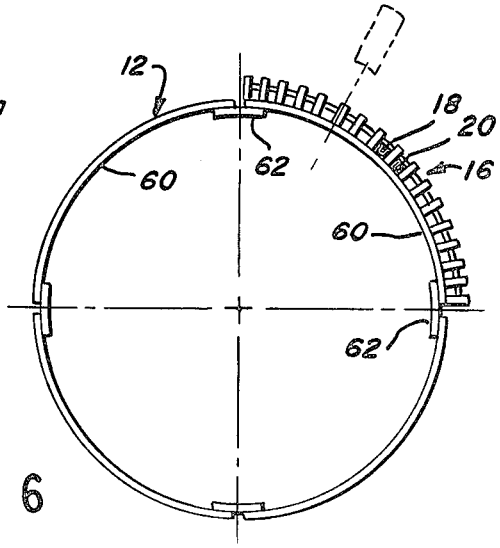
FIG. 6

HANG-RACK ASSEMBLY

BACKGROUND OF THE INVENTION

This invention generally relates to a fixture for displaying and storing merchandise and more particularly to a demountable and expandible hang-rack assembly for displaying clothing on hang-rods or other merchandise on shelves.

Fixtures for displaying clothing articles and accessories are generally known. They come in different shapes and sizes. Since the stores in which such fixtures are used have different space requirements, it is manifest that a manager in charge of the store has to purchase a number of different size fixtures. For example, if the store has several departments, the requirements for particularly structured fixtures will vary from one department to another, depending on the type of clothing and accessories sold in the department, such as men's, women's and children's. Thus, if one fixture can support 30 garments, another fixture is needed to support an additional 30 garments, therefore, the number of needed fixtures is entirely dependent on the number of garments. Then again, as the garment inventory is reduced, it is necessary to remove the idle fixtures from the department premises. The disadvantage of removal of excess fixtures is time consuming and further requires storage space.

SUMMARY OF THE INVENTION

The present invention comprises a hang-rack assembly having a compact base structure which can be expanded into various multiple configurations, as required by merchandise quantities and display requirements. Essentially, the hang-rack assembly has a base structure having one or more leg members which can be extended outwardly from the base structure to a desired length. Each leg member comprises an end wall which, in its extended position, is supported by two or more extensible members, one or more of such extensible members functioning as a hang-rod for supporting garments and the other extensible member functioning as a tie rod. Additional extensible members in the form of shelves can be used to provide support areas for displaying articles which cannot be supported by hangers from the hang-rod. The base structure is a self-contained unit which can be set-up on a floor area, independent of any structure member used in the construction of the store building. Since the base structure includes demountable components, the base structure may be incorporated with the building structural member; such as a post or column, to conceal the lower portion of such column. Further, the extensible members can be adjusted to a particular length within a predetermined range.

The basic purpose of the hang-rack fixture is to accommodate an influx of seasonal or promotional merchandise without requiring the purchase of additional fixtures or bringing in additional fixtures from storage. The fixture remains on floor at all times and functions to display the merchandise, such as garments, either a few garments or many garments on a hang-rod. The fixture is made of components which are linked with each other to avoid the loss of separable components. The simplicity of the fixture construction permits easy installation without requiring particular skills or abilities on part of the installing personnel.

Accordingly, it is the object of the invention to provide a hang-rack assembly having a compact structure which can be expanded into one or more configurations for supporting articles such as clothing and/or accessories.

Another object of the invention is to provide a hang-rack assembly having a demountable base structure which can be mounted about a building structural member such as a column.

A further object of the invention is to provide a hang-rack assembly having a base structure provided with a plurality of end walls, each adapted to be extended outwardly away from the base structure by means of extensible members, one or more of which are utilized to support articles of wear or other merchandise.

A still further object of the invention is to provide a hang-rack assembly provided with a plurality of extensible members for supporting articles of merchandise, each extensible member being adjustable in length within a predetermined range as dictated by spatial limitations or merchandise quantities.

DESCRIPTION OF THE DRAWINGS

FIG. 1 is a perspective view of a hang-rack assembly, partially extended to support garments;

FIG. 2 is a plan view of the hang-rack assembly shown in FIG. 1;

FIG. 3 is a partial end view of a basic structure showing the slat construction of an end wall;

FIG. 4 is a top layout plan of the hang-rack assembly having a rectangular base structure provided with four leg members which have been fully extended;

FIG. 5 is a top layout of a hang-rack assembly having a triangular base structure provided with three leg members, which have been fully extended;

FIG. 6 is a top layout of a hang-rack assembly having a cylindrical base structure, adapted to have four arcuate end walls, only one slatted end wall being shown;

FIG. 7 is a top layout of a hang-rack assembly having a rectangular base structure provided with four leg members, each provided with a pair of hang-rods; and FIG. 8 is another embodiment of a hang-rack assembly using panel end walls instead of slatted end walls.

DESCRIPTION OF THE PREFERRED EMBODIMENT

The preferred embodiment of a hang-rack assembly 10 is shown in FIGS. 1–3, wherein a base structure 12 comprises a framework made from four upright angle members 22 interconnected at upper and lower ends by transverse members 24 and 26. The interconnections can be made permanent, as by welding or can be made temporary or demountable, as by the use of bolts and nuts. As a further alternative, some of the interconnections may be permanent and the remaining may be demountable. For example, as shown in FIG. 2, in the rectangular base structure 12, which has four corners, A, B, C, and D, the interconnections in corners A and D can be welded and those in corner B and C can be bolted (not shown for simplification purposes).

Each transverse member 24 is provided with a bracket 28 which pivotally supports a hang-rod 18 having cooperating members 30 and 32 which in the present situation are telescoped together. Similarly, each transverse member 26 is provided with a bracket 34 for pivotally supporting one end of a tie rod 20 having cooperating members 36 and 38 which are adapted to be telescoped together. The other end of the hang-rod 18 is adapted to be connected permanently or demountably to an end wall 16. Similarly, the other end of the tie rod 20 is adapted to interconnect permanently or demountably to the lower portion of the end wall 16.

The end wall 16 has a slatted construction comprising a plurality of spaced slats 40 supported by a plurality of transverse members 42, as best viewed in FIG. 3. The slats 40, for example, may have a plurality of holes (not shown) and the transverse members 42 may be rods or tubes which are press fitted into the holes to preserve the spacing between the slats 40.

As previously indicated, the extending ends of the hang-rod 18 and tie rod 20 can be permanently or demountably connected to the end wall. A demountable connection may be achieved in any well known manner, such as a notch in the free end of the member 32 and adapted to engage with the transverse member 42. A permanent connection can be achieved with any well known means, such as by positioning the free end of the member 32 between two adjoining slats 40 and driving a pivot pin through the adjoining slats and the free end of the member 32. Then, during the set-up of the hang-rack assembly 10, the other end of the member 32 would be telescoped into the cooperating member 30. Similarly, same procedure can be followed for connecting the tie rod 20 to the lower portion of the end wall 16. Alternatively, the hang-rod 18 and the tie rod 20 may be single bars having a fixed length. In this case the single bar forming the hang-rod 18 would be pivotally secured at both of its ends to the transverse member 24 and the end wall 16. The companion single bar forming the tie rod 20 would have one end pivotally secured to the bracket 34 and the other end demountably secured to the end wall 16. In such case, the hang-rack assembly shown in FIG. 1 would be disassembled by disconnecting the demountable end of the tie rod 20 and pivoting the tie rod in a counter-clockwise direction until it is in an upright position with the demountable end adjoining the transverse member 24. Then, the lower end of the end wall 16 would be swung outwardly in a counter-clockwise direction about the pivot connection with the hang-rod 18 until the hang-rod was lodged between two respective slats forming the pivot connection. Thereafter, the combination of the lodged hang-rod 18 and the end wall 16 would be pivoted clockwise about the pivot bracket 28 until the upper portion of the end wall 16 came in contact with the transverse member 26. Then the end wall 16 can be secured with an appropriate means to the base structure 12.

As can be seen in FIG. 2, the brackets 28 and 34 and the respective hang-rod 18 and tie rod 20 occupy positions between slats 40 thereby presenting a compact unit for storage.

The hang-rod 18 functions to support a number of garments, each of which is mounted on a hanger for suspension from the hang-rod 18. If the garments are short, the space below the garments may be used to install one or more shelves 44 as shown in phantom. These shelves may have telescopic construction so that they may be extended to the same length as the hang-rod 18 and the tie rod 20. The shelves 44 are supported by clips 58 adjustably positioned on the upright members 22 and on the slats 40.

If additional hanging support is needed for garments, the hang-rack assembly 10 may be provided with a further hang-rod 46, as shown in phantom in FIG. 1. Such a hang-rod 46 would comprise a pair of telescopic rods 48 and 50 pivotally secured to an upright member 52 telescopically in engagement with a hollow member 54 mounted to and extending between the transverse members 24 and 26. The other end of the hang-rod 46 is demountably connected to an upright member 56 slidably engaged within another hollow member (not shown) disposed between a pair of adjoining slats 40 in the end wall 16.

The hang-rack assembly 10 having a rectangular base structure 12 is shown in FIG. 4 in fully extended position, wherein four hang-rods 18 are provided for supporting garments.

Another embodiment of the hang-rack assembly is shown in FIG. 5, wherein the base structure 12 has a triangular shape and provides three hang-rods 18.

A further embodiment of the hang-rack assembly is shown in FIG. 6, wherein the base structure 12 has a circular shape and is provided with four arcuate slatted end walls 16, only one of which is shown. These arcuate end walls can be fully extended in a similar manner as shown for the embodiment in FIG. 4. The base structure 12 comprises quadrant members 60 coupled to arcuate upright members 62. The arcuate slatted end walls 16 are attached to the base structure 12 by means of a hang-rod and a tie rod, in a similar way as described in connection with the embodiment shown in FIG. 1.

For simplification purposes, the tie rods 20 are not shown in FIGS. 4 and 5.

Still another embodiment of the hang-rack assembly **10*a* is shown in FIG. 7, wherein a base structure 12*a* is provided with a pair of hang-rods 18*a* and 18*b* which are used in conjunction with a tie rod 20*a* to support end walls 16*a***.

The final embodiment of the hang-rack assembly **10*b* is shown in FIG. 8, wherein solid panel end walls 16*b* are used instead of slatted end walls 16 as shown in FIG. 1. In this embodiment, however, a provision must be made for accommodating the hang-rod 18*b* and the tie rod 20*b*. Therefore, the upper transverse members 24*b* are provided with indentations 64 in which brackets 28*b* can be mounted. The indentations are wide enough to accept the end of a folded tie rod 20*b*** when the hang-rack assembly is in stored or transport condition.

The base structure 12 is provided with leveling members (not shown) which are attached to the lower ends of the upright angle members 22 so that the base structure can be positioned properly in case the floor is not level. Although the base structure 12 uses transverse and upright members to define a framework, it is apparent that other structural members can be used.

The end walls 16 and **16*b* are utilized for displaying the type of garments which are supported on the hang-rods 18 and 18*b*. For example, the end wall 16, as shown in FIG. 1, has a hanger bracket 66 which can be removably supported from one of the transverse members 42 at any desired height. The hanger bracket 66 has one or more slots 68** adapted to receive a conventional clothes hanger supporting a garment.

Considering the embodiment shown in FIGS. 1–3, the rectangular base structure 12 and the end walls 16, when not extended, occupy a square area having a two foot length and a height about five feet. In its fully extended position having four extended legs, the hang-rack assembly 10 provides 20 lineal feet of hang-rod support, or about 5 lineal feet per extended leg.

Referring to the embodiment shown in FIG. 7, wherein a pair of hang-rods **18*a* and 18*b* are used, the dimensions of the hang-rack assembly 10*a*** is a 4 foot square with a height of about 6 feet. The total hang-rod support would be about 40 lineal feet.

The hang-rack assembly may ultimately influence the size and the number of stockrooms used for storing the merchandise prior to its introduction in the sales room area. Merchants, store managers, department heads, etc. generally prefer to have all merchandise displayed in the sales room where it can be readily sold, as opposed to the storage of the merchandise in stockrooms. This arrangement improves selling efficiency since the sales personnel is not required to go into the stockroom to seek a particular size, color, style, etc. of the merchandise.

While there are shown and described herein certain specific structures and embodiments of the invention, it will be manifest to those skilled in the art that various modifications and re-arrangements of parts may be made without departing from the spirit and scope of the underlying inventive concept and that the same is not limited to the particular forms herein shown and described except insofar as indicated by the scope of the appended claims.

What is claimed is:

1. A hang-rack assembly for supporting and displaying articles of merchandise, comprising a base structure, wall means, and means for extendibly interconnecting said wall means to said base structure, said interconnecting means comprising at least one hang-rod and one tie rod, one end of the hang-rod being pivotally connected to the base structure and the other end of the hang-rod being pivotally connected to the wall means, one end of said tie rod being pivotally connected to said base structure and the other end being demountably connectible to said wall means.

2. The assembly according to claim 1, wherein said hang-rod and said tie rod are adjustable in length within a predetermined range.

3. The assembly according to claim 1, wherein said wall means comprise an end wall constructed of upright slats spaced from each other, and a plurality of transverse members interconnecting said slats together.

4. The assembly according to claim 1, wherein said wall means comprise an end wall in the form of a panel.

5. The assembly according to claim 1, including an additional hang-rod associated with said wall means, an upright member extendible out of said base structures for pivotally supporting one end of said additional hang-rod, and an upright member extendible out of said wall means for demountably supporting the other end of said additional hang-rod.

6. The assembly according to claim 1, wherein said wall means comprise an end wall constructed of upright slats, spaced from each other, and a plurality of transverse members interconnecting said slats together, and wherein said interconnecting means comprise at least one hang-rod removably disposed between said slats and at least one tie rod removably disposed between said slats, one end of said hang-rod being pivotally connected to said base structure and the other end of said hang-rod being pivotally connected to the end wall, one end of said tie rod being pivotally connected to said base structure and the other end being demountably connectible to said end wall.

7. The assembly according to claim 6, wherein said base structure is rectangular in configuration and includes four end walls.

8. The assembly according to claim 6, wherein said base structure is triangular in configuration and includes three end walls.

9. The assembly according to claim 6, wherein said base structure is cylindrical in configuration and includes two or more arcuate end walls.

10. The assembly according to claim 1, wherein said wall means comprise an end wall in the form of a panel abutting said base structure, said base structure adjoining each abutted panel having at least a pair of inwardly directed indentations, and wherein said interconnecting means comprise at least one hang-rod removably disposed in said indentations and at least one tie rod removably disposed in said indentations, one end of said hang-rod being pivotally connected to said base structure and the other end being connectible to said panel, one end of said tie rod being pivotally connected to said base structure and the other end being connectible to said panel.

11. The assembly according to claim 1, including at least one shelf, and means for demountably attaching said shelf to said base structure and said wall means.

12. A collapsible hang-rack assembly for supporting and displaying garments, said assembly, in its collapsed form defining a compact unit ideal for storage and transit, and in its extended form defining optimal hanging support for the garments, comprising a base structure, two or more display walls, and means interconnecting each of said display walls with said base structure between the collapsed and extended forms, said interconnecting means comprising at least one hang-rod and one tie rod associated with each display wall, one end of said hang-rod being pivotally connected to either of said base structure and display wall and the other end being connectible to either of said display wall and base structure, one end of said tie rod being pivotally connected to either of said base structure and display wall and the other end being connectible to either of said display wall and base structure whereby said connectible connections are effected when said assembly is in its extended form.

13. The assembly according to claim 12, wherein said connectible end of said hang-rod is pivotally connected to either of said display wall and base structure.

14. The assembly according to claim 12, including means in each of said walls forming a housing for said hang-rod and said tie rod when said assembly is in its collapsed form.

15. The assembly according to claim 12, including means in said base structure forming a housing for said hang-rod and said tie rod when said assembly is in its collapsed form.

* * * * *